US005337710A

United States Patent [19]

Adam

[11] Patent Number: 5,337,710

[45] Date of Patent: Aug. 16, 1994

[54] INJECTION ARRANGEMENT FOR A TWO-STROKE ENGINE

[75] Inventor: Roland Adam, Besigheim, Fed. Rep. of Germany

[73] Assignee: Andreas Stihl, Waiblingen, Fed. Rep. of Germany

[21] Appl. No.: 61,048

[22] Filed: May 14, 1993

[30] Foreign Application Priority Data

May 16, 1992 [DE] Fed. Rep. of Germany ... 9206687[U]

[51] Int. Cl.[5] ..... F02B 63/02; F02M 69/02; F02M 35/10; F02D 9/10

[52] U.S. Cl. ..... 123/73 C; 123/DIG. 5; 417/364; 417/234

[58] Field of Search ..... 123/73 R, 73 A, 73 B, 123/73 C, 73 CB, 403, 65 P, 73 V, DIG. 5, 509; 417/395, 364, 234

[56] References Cited

U.S. PATENT DOCUMENTS

| | | | |
|---|---|---|---|
| 3,698,368 | 10/1972 | Yamamoto | 123/73 A |
| 4,594,971 | 6/1986 | Borst | 123/DIG. 5 |
| 4,807,573 | 2/1989 | Schierling et al. | 417/395 |
| 4,846,119 | 6/1989 | Geyer et al. | 123/73 C |
| 4,932,370 | 6/1990 | Schierling et al. | 123/73 C |
| 4,976,246 | 12/1990 | Schierling et al. | 123/509 |
| 5,197,417 | 3/1993 | Tuckerman et al. | 123/73 C |
| 5,201,288 | 4/1993 | Doragrip | 123/73 A |
| 5,239,967 | 8/1993 | Adam | 123/73 CB |

*Primary Examiner*—Tony M. Argenbright
*Assistant Examiner*—M. Macy
*Attorney, Agent, or Firm*—Walter Ottesen

[57] ABSTRACT

A fuel-injection arrangement and a two-stroke engine define a combination for a portable handheld work apparatus such as a motor-driven chain saw or the like. The combination includes a fuel-feed pump for pumping fuel from a fuel tank and a fuel-injection pump for supplying the fuel for injection into the engine. The fuel-feed pump and the fuel-injection pump are mounted in a con, non injection-pump block separate from the engine. The engine has an intake channel through which combustion air is drawn into the engine and the intake channel is configured so as to open directly into the engine. A throttle flap is pivotally mounted in the intake channel as to be completely separate from the common injection-pump block. The injection pump block is effectively thermally decoupled from the intake channel. The danger of vapor bubble formation because of a heating of the injection pump is thereby reliably avoided. A good decoupling of the injection pump from intensely vibrating engine components can also be provided in this manner.

3 Claims, 2 Drawing Sheets

INJECTION ARRANGEMENT FOR A TWO-STROKE ENGINE

FIELD OF THE INVENTION

The invention relates to an injection arrangement for a two-stroke engine in a portable handheld work apparatus such as a motor-driven chain saw or the like.

BACKGROUND OF THE INVENTION

An injection arrangement of the kind referred to above is disclosed in U.S. Pat. No. 4,976,246. In this arrangement, the injection arrangement is connected to the engine and to the fuel tank via flexible connecting lines. The injection-pump block, which includes the fuel-feed pump and the injection pump, includes an intake channel section wherein a throttle flap is mounted for metering the combustion air required for the combustion. The injection-pump block must be mounted in the vicinity of the two-stroke engine, because the intake channel cannot be configured to be of any arbitrary length. Accordingly, heating of the injection-pump block by radiation heat of the two-stroke engine cannot be precluded. In the hot injection pump, the fuel conducted therethrough becomes warm and its constituents having a low boiling point tend thereby to vaporize. This causes vapor bubbles to be produced which disturb the correct metering of fuel and lead to an irregular running of the engine. Accordingly, thermal insulation must be provided for an undisturbed operation of the injection pump. Intermediate walls and insulation material between the engine and the injection pump are, however, complex and require a great amount of space.

SUMMARY OF THE INVENTION

It is an object of the invention to provide an injection arrangement which reliably avoids heating the injection pump.

The combination of the invention of a fuel-injection arrangement and a two-stroke engine is for a portable handheld work apparatus such as a motor-driven chain saw or the like. The combination includes: a fuel tank for supplying fuel for the engine; the engine having a crankcase wherein a crankcase pressure is developed during operation of the engine; a fuel-feed pump having a suction line connected to the fuel tank and having a pressure line; the crankcase being operatively connected to the fuel-feed pump for driving the pump to pump fuel from the tank through the suction line; a fuel-injection pump having a suction end connected to the pressure line and a pressure end for supplying fuel for injection into the engine; the fuel-feed pump and the fuel-injection pump being mounted in a common injection-pump block separate from the engine; the engine having an intake channel through which combustion air is drawn into the engine; the intake channel being configured so as to open directly into the engine; a throttle flap pivotally mounted in the intake channel so as to be completely separate from the common injection-pump block; an injection line connected to the pressure end of the fuel-injection pump for conducting the fuel for injection into the engine to mix with the combustion air to form an ignitable fuel/air mixture; and, control means for controlling the application of the crankcase pressure to the fuel-injection pump for driving the fuel-injection pump.

According to a feature of the invention, the throttle flap is mounted in the intake channel section directly at the engine and separate from the injection-pump block. In this way, the intake channel section within the injection-pump block can be omitted and the injection-pump block can be arranged completely separate from the arrangement of the two-stroke engine and of the intake channel at a favorable position in the housing of the work apparatus where a thermal warming does not take place. The danger of vapor bubble formation because of a heating of the injection pump is thereby reliably avoided. A good decoupling of the injection pump from intensely vibrating engine components can also be provided in this manner. An attachment in the handle of the housing of the work apparatus, which is vibration-attenuated, is possible.

According to another feature of the invention, the intake channel section holding the throttle flap and the crankcase of the two-stroke engine can be configured as a single piece.

BRIEF DESCRIPTION OF THE DRAWINGS

The invention will now be described with reference to the drawings wherein.

DESCRIPTION OF THE PREFERRED EMBODIMENTS OF THE INVENTION

Figure 1:
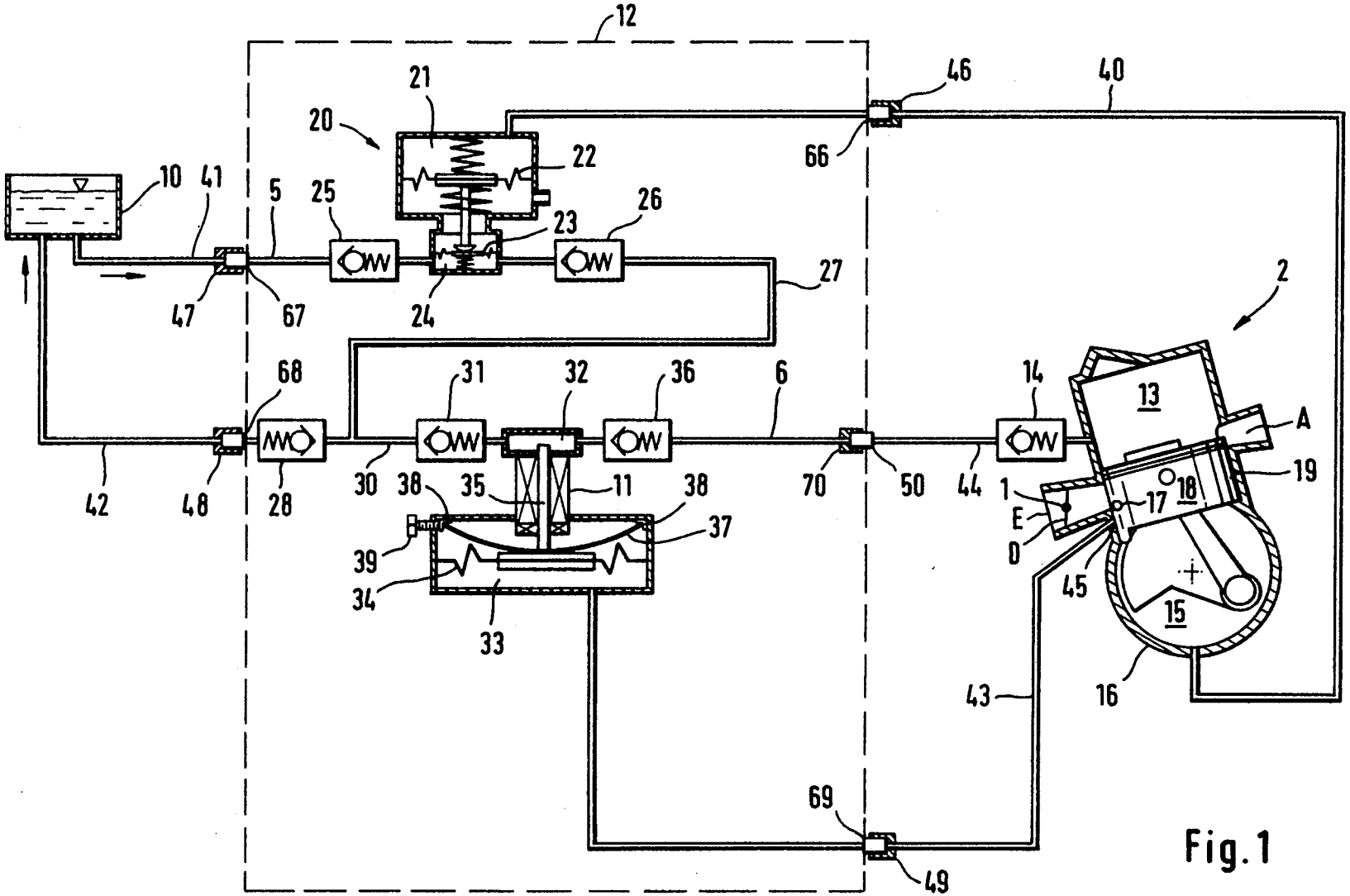
FIG. 1 is a schematic of the combination of the fuel-injection arrangement and the two-stroke engine; and, FIG. 2 is a perspective view of the injection-pump block.

The injection arrangement shown in FIG. 1 supplies fuel to a two-stroke engine 2. The two-stroke engine drives a portable handheld work apparatus such as a motor-driven chain saw, cutoff machine, brushcutter or the like. A fuel tank 10 is provided in the housing of the work apparatus and fuel is drawn by suction by an injection pump 11 mounted in an injection-pump block 12. The fuel is injected into the combustion chamber 13 of the two-stroke engine 2 via an injection valve 14. The injection-pump block 12 is preferably mounted in a partitioned-off space of the housing separate from the two-stroke engine 2 in order to ensure a thermal decoupling from the engine.

A fuel-feed pump 20 and the injection pump 11 are combined to one assembly in the injection-pump block 12. The fuel-feed pump 20 is driven by the crankcase pressure of the two-stroke engine and, for this reason, a work chamber 21 delimited by a membrane 22 is connected via a line 40 to the inner space 15 of a crankcase 16. The membrane 22 controls a pump membrane 23 via a pin with the pump membrane 23 delimiting a pump chamber 24. The pump chamber 24 communicates via a suction line 5 and a suction valve 25 with a fuel supply 41 which conducts fuel from the fuel tank 10. The fuel is conducted to a suction connection 30 of the injection pump 11 via a pressure valve 26 and a pressure line 27. The suction connection 30 is connected via a suction valve 31 to the injection-pump chamber 32. When the suction valve 31 is closed, the fuel pumped by the fuel-feed pump 20 flows via a pressure-holding valve 28 and a fuel-tank return 42 back into the fuel tank 10; that is, the fuel is circulated by pump action.

The injection pump 11 includes a work chamber 33 which is delimited by a membrane 34 which actuates a pump piston 35. The work chamber 33 communicates via a pulse line 43 and a bore 45 with the inner space 15 of the crankcase 16. The bore 45 is then controlled by a control opening 17 in the piston jacket 18 of the piston 19 so that the pump piston 35 injects fuel into the combustion chamber 13 (in correspondence to the position of the piston 19) via the pressure valve 36 and the injection line 44 as well as the injection valve 14. A force is applied to the pump piston 35 by a leaf spring 37 which determines the rest position of the pump piston 35. The ends of the leaf spring 37 lie in bearings 38 which are supported in the housing of the injection pump 11. One of the bearings 38 is adjustable in its position via an adjusting screw 39 whereby the pretension of the leaf spring 37 can be adjusted.

The engine 2 draws in the combustion air necessary for combustion via an intake channel E into the inner chamber 15 of the crankcase housing 16. The combustion air enters the combustion chamber 13 via flow channels (not shown) controlled by the piston. The exhaust gas developed by the combustion is conducted from the combustion chamber 13 via the outlet channel A.

A throttle flap D is journalled with a pivot pin 1 in the intake channel E. The throttle flap D enables the cross section of the intake channel E, and therefore the quantity of the in-flowing combustion air, to be adjusted. The throttle flap D is controllable via a linkage (not shown) by a throttle lever which is journalled in the housing of the portable handheld work apparatus.

As shown in FIG. 1, the intake channel E of the two-stroke engine 2 is configured as one piece with the crankcase 16. The throttle flap D is supported by the pivot pin 1 which extends across the intake channel E. In addition to the injection-pump block 12, only an air filter has to be arranged in front of the intake channel E for operating the two-stroke engine.

Figure 2:
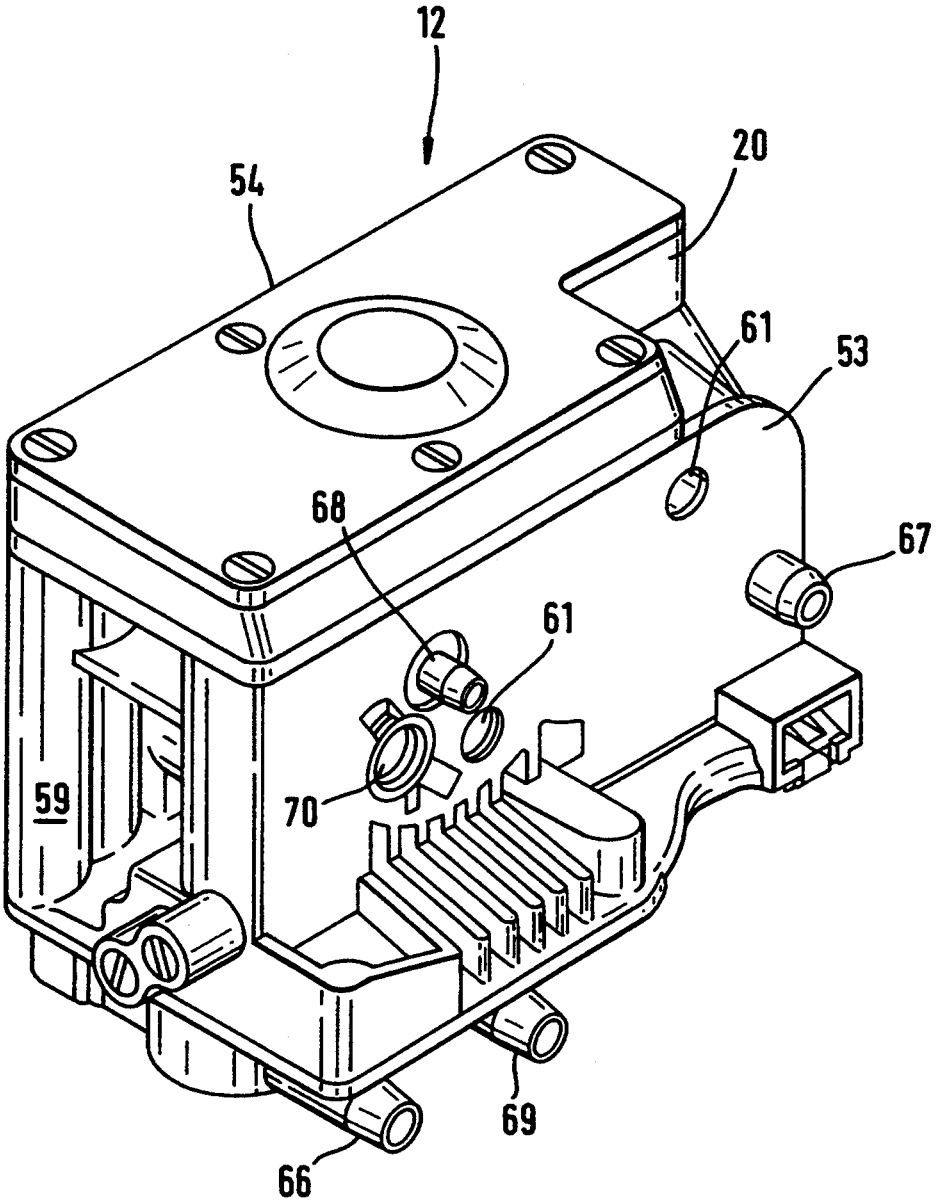

Referring to FIG. 2, through bores 61 are provided in the assembly unit of the injection-pump block 12. These through bores extend in a straight line from one housing side 53 to the other housing side 54 of the parallelopipedly-shaped base body 59 of the injection-pump block 12. Attachment screws can be inserted through the bores 61 by means of which the assembly unit of the injection-pump block 12 can be mounted on a housing wall separate from the two-stroke engine. The injection-pump block can be mounted at a suitable location in the housing of the work apparatus independently of the mounting of the two-stroke engine and the location of the intake channel E because the injection-pump block does not have an intake channel section. In this way, a thermal decoupling as well as a vibration decoupling of the injection pump 11 from the two-stroke engine is ensured without additional measures.

The injection-pump block 12 is held at the housing side 54 tightly against an attachment wall so that the plug-in elements 66 to 69 and connecting receptacle 70, which are provided on the connecting side 53, are easily accessible. The connecting receptacle 46 of the pulse line 40 is pushed onto the plug-in element 66. In the same manner, the connecting receptacle 49 of the pulse line 43 is pushed onto the plug-in element 69. The plug-in elements 67 and 68 provide the connection to the connecting receptacles 47 and 48 of the fuel supply 41 and fuel return 42, respectively. The plug-in element 50 of the injection line 44 is inserted in the receiving bushing of the connecting receptacle 70 to provide a tight high-pressure connection. The receiving bushing of the connecting receptacle 70 is formed in the base body 59 of the injection-pump block 12. The connecting lines between the two-stroke engine and the fuel tank are preferably provided as flexible lines and are especially configured as plastic hoses.

It is understood that the foregoing description is that of the preferred embodiments of the invention and that various changes and modifications may be made thereto without departing from the spirit and scope of the invention as defined in the appended claims.

What is claimed is:

1. The combination of a fuel-injection arrangement and a two-stroke engine of a portable handheld work apparatus, the combination comprising:

a fuel tank for supplying fuel for the engine;

said engine having a crankcase wherein a crankcase pressure is developed during operation of the engine;

a fuel-feed pump having a suction line connected to said fuel tank and having a pressure line;

said crankcase being operatively connected to said fuel-feed pump for driving said pump to pump fuel from said tank through said suction line;

a fuel-injection pump having a suction end connected to said pressure line and a pressure end for supplying fuel for injection into said engine;

said fuel-feed pump and said fuel-injection pump being mounted in a common injection-pump block separate from said engine;

said engine having an intake channel through which combustion air is drawn into said engine;

said intake channel being configured so as to open directly into said engine;

a throttle flap pivotally mounted in said intake channel so as to be completely separate from said common injection-pump block;

an injection line connected to said pressure end of said fuel-injection pump for conducting said fuel for injection into said engine to mix with said combustion air to form an ignitable fuel/air mixture; and, control means for controlling the application of said crankcase pressure to said fuel-injection pump for driving said fuel-injection pump.

2. The combination of claim 1, said channel having an inlet opening into said crankcase; and, said throttle flap being pivotally mounted in said intake channel directly next to said inlet.

3. The combination of claim 1, said intake channel and said crankcase being formed as a single piece.

* * * * *

UNITED STATES PATENT AND TRADEMARK OFFICE

CERTIFICATE OF CORRECTION

PATENT NO. : 5,337,710

DATED : August 16, 1994

INVENTOR(S) : Roland Adam

It is certified that error appears in the above-identified patent and that said Letters Patent is hereby corrected as shown below:

On the title page, in the abstract, line 9: delete "con, non" and substitute -- common -- therefor.

On the title page, in the abstract, line 14: between "channel" and "as", insert -- so --.

Signed and Sealed this

First Day of November, 1994

*Attest:*

*Attesting Officer*

Bruce Lehman

BRUCE LEHMAN

*Commissioner of Patents and Trademarks*